US008773323B1

(12) United States Patent
Manry, Jr. et al.

(10) Patent No.: US 8,773,323 B1
(45) Date of Patent: Jul. 8, 2014

(54) MULTI-BAND ANTENNA ELEMENT WITH INTEGRAL FARADAY CAGE FOR PHASED ARRAYS

(75) Inventors: Charles W. Manry, Jr., Auburn, WA (US); Lixin Cai, Ravensdale, WA (US); Robert M. Burgess, Seattle, WA (US)

(73) Assignee: The Boeing Company, Chicago, IL (US)

( * ) Notice: Subject to any disclaimer, the term of this patent is extended or adjusted under 35 U.S.C. 154(b) by 426 days.

(21) Appl. No.: 13/052,034

(22) Filed: Mar. 18, 2011

(51) Int. Cl.
*H01Q 1/52* (2006.01)

(52) U.S. Cl.
USPC ..... 343/841

(58) Field of Classification Search
USPC ..... 343/700 MS, 769, 778, 789
See application file for complete search history.

(56) References Cited

U.S. PATENT DOCUMENTS

| | | | | |
|---|---|---|---|---|
| 5,539,420 | A * | 7/1996 | Dusseux et al. | 343/769 |
| 6,624,787 | B2 * | 9/2003 | Puzella et al. | 343/700 MS |
| 6,670,930 | B2 * | 12/2003 | Navarro | 343/776 |
| 7,053,847 | B2 * | 5/2006 | Chan et al. | 343/769 |
| 8,279,131 | B2 * | 10/2012 | Puzella et al. | 343/853 |

OTHER PUBLICATIONS

Yu-Jiun Ren et al., "An Ultrawideban Microstrip Dual-Ring Antenna for Millimeter-Wave Applications" 2007, IEEE Antennas and Wireless Propagation Letters, vol. 6, pp. 457-459.*
Jin-Sen Chen, "Dual-Frequency Annular-Ring Slot Antennas Fed by CPW Feed and Microstrip Line Feed," IEEE Transactions APS, vol. 53, No. 1, Jan. 2005, p. 569-571.
Yu-Jiun Ren, "An Ultrawideband Microstrip Dual-Ring Antenna for Millimeter-Wave Applications," IEEE Antennas & Wireless Propagation Letters, vol. 6, 2007, p. 457-459.
A Das,B. Sc., M.sc, et al, "Radiation Characteristics of Higher-Order Modes in Microstrip Ring Antenna," IEE Proceedings, vol. 131, Pt H, No. 2, Apr. 1984, p. 102-103.
Weng Cho Chew, "A Broad-Band Annular-Ring Microstrip Antenna", IEEE Transactions APS, vol. AP-30, No. 5, Sep. 1982, Section I p. 918-919, Section V p. 920-921.
I.J. Bahl, et al, "A New Microstrip Radiator for Medical Applications," IEEE Transactions on Microwave Theory and Techniques, vol. MTT-28, No. 12, Dec. 1980, p. 1464-1468.

* cited by examiner

*Primary Examiner* — Sujoy Kundu
*Assistant Examiner* — Steven J Malone
(74) *Attorney, Agent, or Firm* — Ameh IP; Lowell Campbell; Elahe Toosi

(57) ABSTRACT

An antenna structure and method is disclosed. A feed line is electromagnetically coupled to a conductive resonator. Further a faraday cage is operable to shield the conductive resonator and the feed line. The faraday cage comprises an electromagnetically-shielding ground plane coupled to a plurality of conductive strips by at least one conductive via.

20 Claims, 7 Drawing Sheets

MULTI-BAND ANTENNA ELEMENT WITH INTEGRAL FARADAY CAGE FOR PHASED ARRAYS

FIELD

Embodiments of the present disclosure relate generally to antennas. More particularly, embodiments of the present disclosure relate to microwave and millimeter-wave frequency antennas.

BACKGROUND

Current microwave and millimeter-wave frequency antennas generally comprise cumbersome structures such as waveguides, dish antennas, helical coils, horns, and other large non-conformal structures. Communication applications where at least one communicator is moving and radar applications generally require a steerable beam and/or steerable reception. Phased array antennas are particularly useful for beam steered applications since beam steering can be accomplished electronically without physical motion of the antenna. Such electronic beam steering can be faster and more accurate and reliable than gimbaled/motor-driven mechanical antenna steering.

SUMMARY

An antenna structure and method is disclosed. A feed line is electromagnetically coupled to a conductive resonator, and a faraday cage is operable to shield the conductive resonator and the feed line. The faraday cage comprises an electromagnetically-shielding ground plane coupled to a plurality of conductive strips by at least one conductive via.

In this manner, the antenna structure provides a wide scan volume (e.g., better than 60 degrees of conical scan volume from boresight) and maintains good circular polarization axial ratio over specified frequency bands.

The antenna structure minimizes size, weight, and power (SWAP), as well as minimizing integration cost. SWAP is greatly reduced by elimination of "stovepiped" Satellite Communication (SATCOM) narrow banded systems and associated separate antenna installations. The antennas structure provides a phased array antenna that can cover at least one SATCOM transmit and/or receive military Extremely High Frequency (EHF) band, while being thin and lightweight. Furthermore, the antenna structure may be scaled to other frequency bands and phased array applications such as, for example but without limitation, Line-of-Sight communication links, Signals Intelligence (SIGINT) arrays, radars, sensor arrays, and the like. In addition, the antenna structure provides a conformal antenna operable to greatly reduce aerodynamic drag and integration/maintenance cost.

In an embodiment, an antenna structure comprises a conductive resonator. A feed line is electromagnetically coupled to the conductive resonator. Further, the antenna structure comprises a faraday cage operable to shield the conductive resonator and the feed line. The faraday cage comprises an electromagnetically-shielding ground plane coupled to a plurality of conductive strips by at least one conductive via.

In another embodiment, a method for forming an antenna structure provides an electromagnetically-shielding ground plane, and at least one first dielectric layer on the electromagnetically-shielding ground plane. The method further provides a plurality of conductive vias electrically coupled to the electromagnetically-shielding ground plane through the at least one first dielectric layer. The method also provides at least one first faraday cage perimeter layer on the at least one first dielectric layer, and coupled to the conductive vias. The method then provides at least one feed line on at least one layer of the at least one first dielectric layer, and at least one second dielectric layer on the at least one first dielectric layer. The method also provides at least one second faraday cage perimeter layer coupled to the conductive vias through the at least one second dielectric layer and provides a resonator on the at least one second dielectric layer.

In yet another embodiment, a method for communication using an antenna structure resonates a conductive resonator that is electromagnetically coupled to a feed line. The method further electromagnetically-shields the conductive resonator and the feed line using a faraday cage comprising an electromagnetically-shielding ground plane coupled to a plurality of conductive strips by at least one conductive via.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF DRAWINGS

A more complete understanding of embodiments of the present disclosure may be derived by referring to the detailed description and claims when considered in conjunction with the following figures, wherein like reference numbers refer to similar elements throughout the figures. The figures are provided to facilitate understanding of the disclosure without limiting the breadth, scope, scale, or applicability of the disclosure. The drawings are not necessarily made to scale.

DETAILED DESCRIPTION

Figure 1:
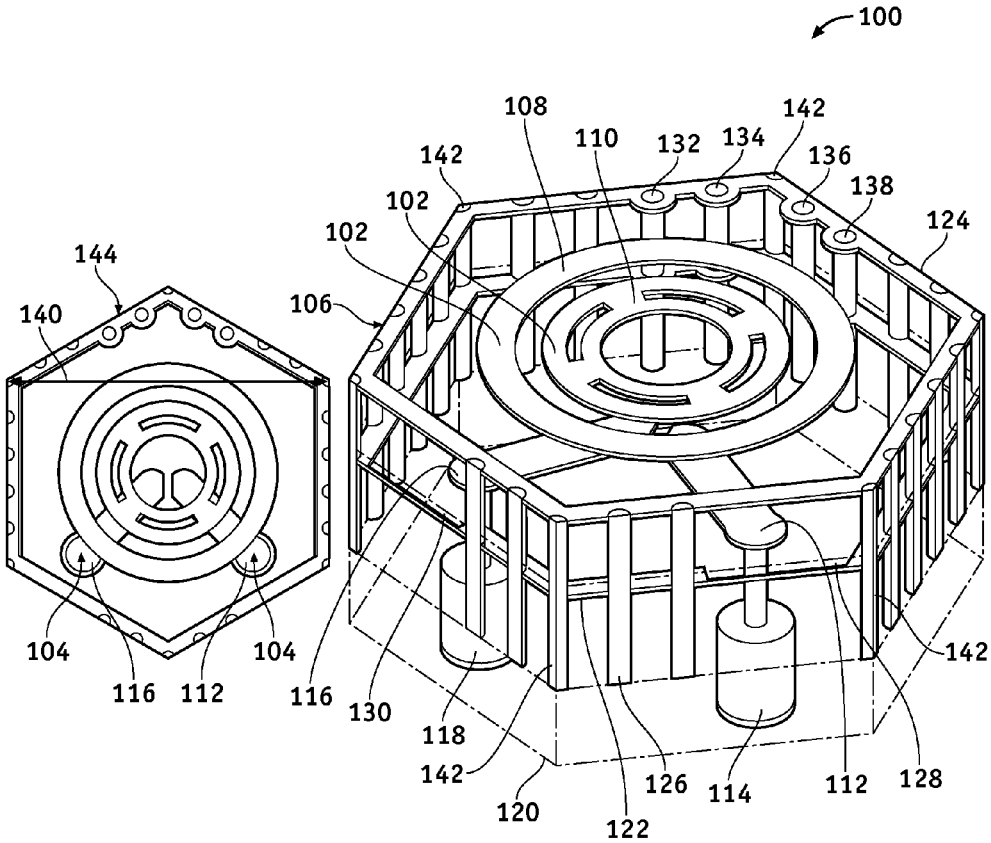
FIG. 1 is an illustration of an exemplary antenna structure according to an embodiment of the disclosure.

The following detailed description is exemplary in nature and is not intended to limit the disclosure or the application and uses of the embodiments of the disclosure. Descriptions of specific devices, techniques, and applications are provided only as examples. Modifications to the examples described herein will be readily apparent to those of ordinary skill in the art, and the general principles defined herein may be applied to other examples and applications without departing from the spirit and scope of the disclosure. The present disclosure should be accorded scope consistent with the claims, and not limited to the examples described and shown herein.

Embodiments of the disclosure may be described herein in terms of functional and/or logical block components and various processing steps. It should be appreciated that such block components may be realized by any number of hardware, software, and/or firmware components configured to perform the specified functions. For the sake of brevity, conventional techniques and components related to antenna design, antenna manufacturing, and other functional aspects of the systems (and the individual operating components of the systems) may not be described in detail herein. In addition, those skilled in the art will appreciate that embodiments of the present disclosure may be practiced in conjunction with a variety of hardware and software, and that the embodiments described herein are merely example embodiments of the disclosure.

Embodiments of the disclosure are described herein in the context of a practical non-limiting application, namely, a planar or conformal satellite communication phased array antenna. Embodiments of the disclosure, however, are not limited to such planar satellite communication applications, and the techniques described herein may also be utilized in other applications. For example but without limitation, embodiments may be applicable to conformal antennas, manned and unmanned aircraft antennas, sensor antennas, radar antennas, and the like.

As would be apparent to one of ordinary skill in the art after reading this description, the following are examples and embodiments of the disclosure and are not limited to operating in accordance with these examples. Other embodiments may be utilized and structural changes may be made without departing from the scope of the exemplary embodiments of the present disclosure.

Current microwave scanning antennas use multiple phased array antenna apertures for each band and/or dual band dish antennas under radomes. On-aircraft dishes generally must be placed under aerodynamic radomes adding significantly to weight of an aircraft, aerodynamic drag and maintenance complication.

Embodiments of the disclosure provide a conformal phased array antenna element for a single/multi-band transmit and/or receive aperture for bi-directional satellite communication and other communications, for example but without limitation, the military bands of 30-31 GHz, and 43.5-45.5 GHz, signals in adjacent Ka-bands, and the like. Embodiments of the disclosure provide for a light weight and very thin single transmit and/or receive conformal phased array antenna element, with wide scan volume to about 60 degrees or greater angle from boresight.

FIG. 1 is an illustration of an exemplary antenna structure 100 (structure 100) according to an embodiment of the disclosure. The antenna structure 100 comprises a conductive resonator 102, feed lines 104, and a faraday cage 106.

The conductive resonator 102 is operable to resonate at electromagnetic frequencies to be transmitted or received. The conductive resonator 102 may comprise, for example but without limitation, a single resonator, a plurality of resonators, slotted resonators, resonators on multiple layers, and the like. In the embodiment shown in FIG. 1, the conductive resonator 102 may comprise at least one ring structure such as a ring conductive resonator 108 and at least one spoked structure such as a spoked conductive resonator 110. The ring conductive resonator 108 and the spoked conductive resonator 110 may comprise, for example but without limitation, metallization, a microstrip, direct-write, and the like.

Figure 2:
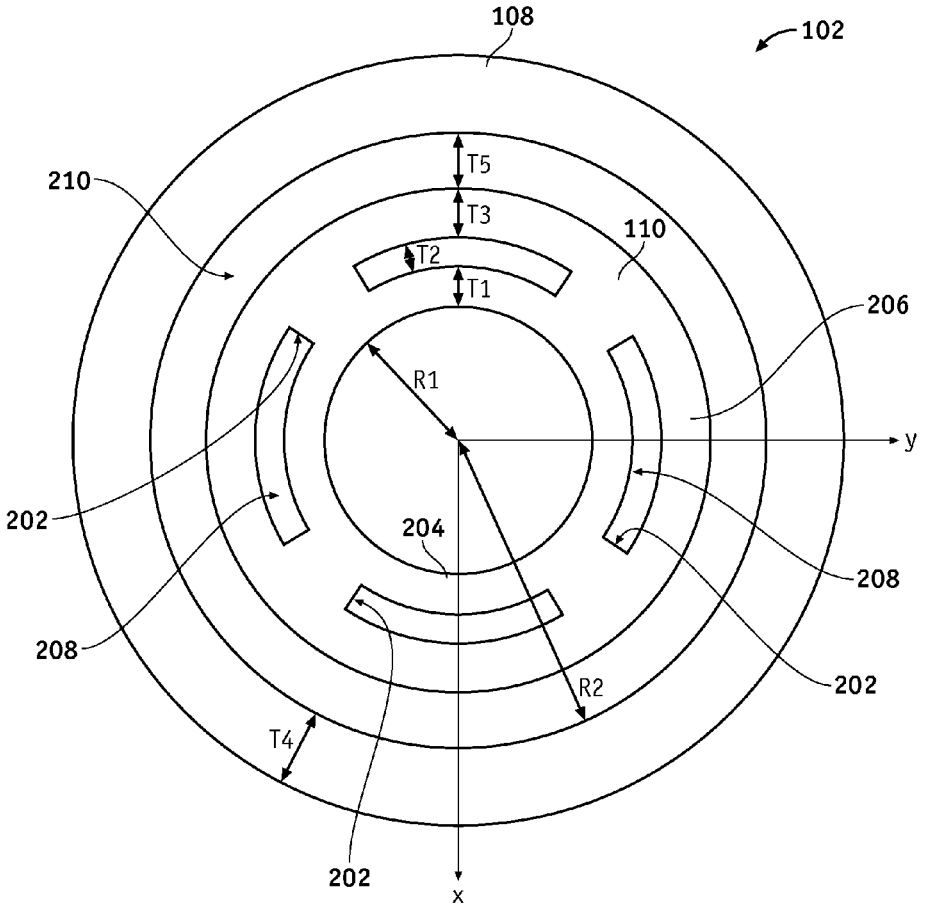
FIG. 2 is an illustration of an exemplary expanded view of a conductive resonator of FIG. 1 according to an embodiment of the disclosure.

As discussed below in more detail in the context of discussion of FIG. 2, the conductive resonator 102 comprises the ring conductive resonator 108 (ring shaped microstrip), and the spoked conductive resonator 110 comprises an inner linked ring 204 and an outer linked ring 206 (FIG. 2) coupled by one or more spoke 202 (FIG. 2) and separated by one or more slot radiator 208 (FIG. 2). Use of the ring conductive resonator 108 as an outer ring, the spoked conductive resonator 110, and a slot resonator 210 (FIG. 2) between the ring conductive resonator 108 and the spoked conductive resonator 110, provides an antenna structure operable to achieve a dual band operation according to an embodiment of the disclosure. However, in other embodiments, various shapes and combinations of resonators may be used to form a single-band antenna operable in a single frequency band, or a multi-band antenna capable of operation in two or more frequency bands.

For example but without limitation, the ring conductive resonator 108 is operable in a 30-31 GHz frequency band, and the slot resonator 210 between the ring conductive resonator 108 and the spoked conductive resonator 110 is operable to provide a tuning structure for a 43.5-45.5 GHz frequency band. The spoked conductive resonator 110 may comprise a smaller linked double ring structure comprising spokes 202, the inner linked ring 204, and the outer linked ring 206 operable to provide a tuning structure for the slot radiator 208 between the inner linked ring 204 and the outer linked ring 206.

Each of the feed lines 104 (feed line 104) is electromagnetically coupled to the conductive resonator 102 and is configured to drive the conductive resonator 102 and/or receive a signal from the conductive resonator 102. The feed lines 104 may comprise, for example but without limitation, a single feed line, a plurality of feed lines, and the like. In the embodiment shown in FIG. 1, the feed lines 104 comprise a first feed line 112 coupled to a first signal line 114, and a second feed line 116 coupled to a second signal line 118. The first feed line 112 and the second feed line 116 may comprise, for example but without limitation, metallization, a microstrip, and the like. The feed lines 104 comprise microstrip feed lines electromagnetically coupled to the conductive resonator 102.

The electromagnetic coupling comprises, for example but without limitation, an inductive coupling, a capacitive coupling, and the like. The feed lines 104 may be located on a middle layer 304 (FIG. 3) below the conductive resonator 102. For example but without limitation, the feed lines 104 may be located about 20 mils below the conductive resonator 102, and the like. The feed lines 104 may be coupled to external electronics (not shown) using coupling vias (i.e., vias other than the conductive vias 126) through an electromagnetically-shielding ground plane 120 to the feed lines 104. The feed lines 104 may be spaced, for example but without limitation, about 90 degrees apart to allow for selectable right-hand circular polarized or left-hand circular polarized Satellite Communications (SATCOM) signals, and the like.

The faraday cage 106 is configured to shield the conductive resonator 102 and the feed lines 104. In this manner, the faraday cage 106 comprises the electromagnetically-shielding ground plane 120, a first conductive strip 122, a second conductive strip 124, and a plurality of conductive vias 126. The conductive vias 126 are coupled to the electromagnetically-shielding ground plane 120, the first conductive strip 122, and the second conductive strip 124 to form an electrically conductive cage operable to isolate/shield the conductive resonator 102 and the feed lines 104 from bottom and side external electrical fields such as a neighboring antenna. The neighboring antenna may comprise, for example but without limitation, structure 100 as an element of a lattice 506/602 (FIGS. 5-6), external antennas of neighboring devices, and the like. The faraday cage 106 may comprise, for example but without limitation, metallization, a microstrip, a circuit board material, direct write, and the like.

Figure 5:
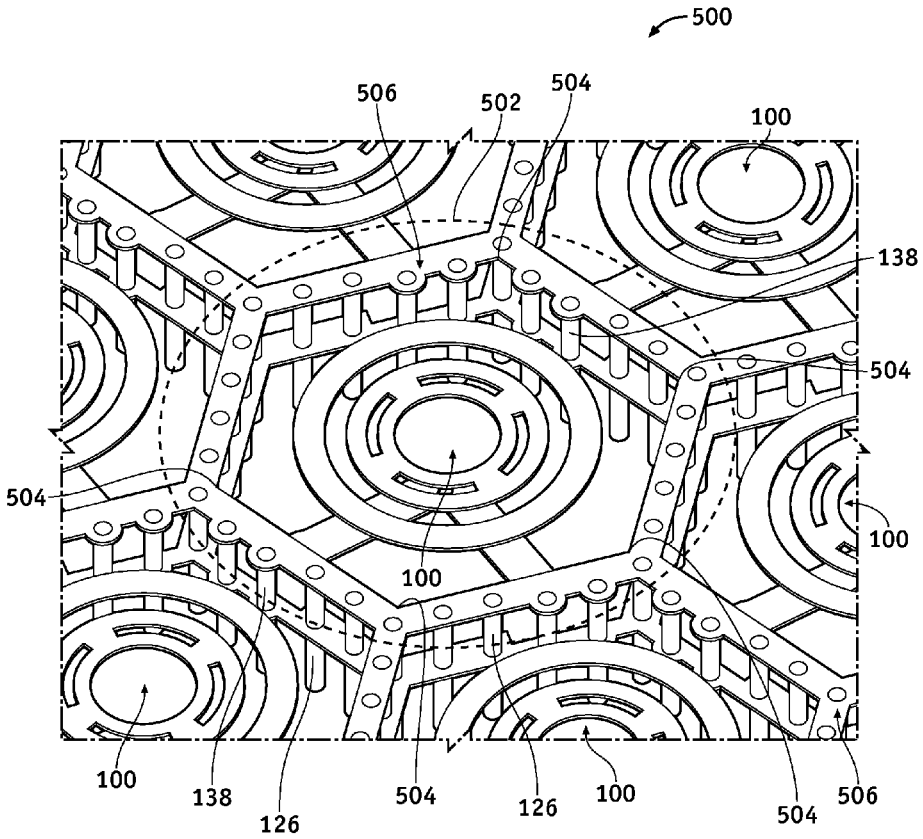
FIG. 5 is an illustration of an exemplary phased array antenna structure according to an embodiment of the disclosure.
Figure 6:
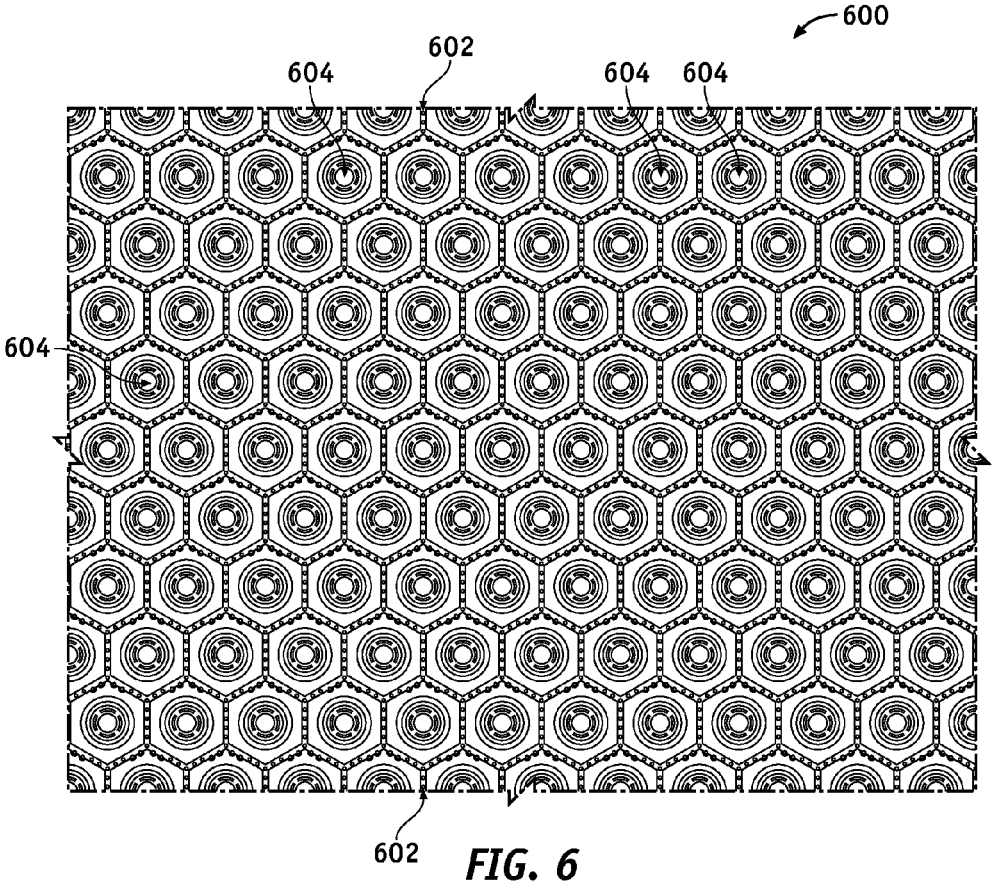
FIG. 6 is an illustration of an exemplary fabricated phased array antenna structure according to an embodiment of the disclosure.

The faraday cage 106 may comprise a periodic unit cell (e.g., unit cell 502 in FIG. 5) outer boundary outline printed on layers of a circuit board with the conductive vias 126 extending from the top layer 144 of the structure 100 to the electromagnetically-shielding ground plane 120. The conductive vias 126 are spaced along the first conductive strip 122 and the second conductive strip 124 and vertices 142 of the antenna structure 100. The faraday cage 106 may be made using any appropriate lattice spacing and shape to form a phased array antenna (FIGS. 5-6). The faraday cage 106 may comprise, for example but without limitation, a hexagonal lattice, a triangular lattice, a square lattice, and the like. In this manner, the antenna structure 100 forms a phased array antenna where the conductive strips 122/124 form the lattice 506/602 (FIGS. 5-6).

The faraday cage 106 may comprise a first notch 128 near the first feed line 112 and a second notch 130 near the second feed line 116 to minimize interaction of the feed lines 104 with the faraday cage 106. Furthermore, a subset of the conductive vias 126 may be offset near the feed lines 104 to minimize interaction of the feed lines 104 with the faraday cage 106. The subset may comprise offset vias such as a first offset via 132, a second offset via 134, a third offset via 136, and a fourth offset via 138.

FIG. 2 is an illustration of an expanded view of the conductive resonator 102 of FIG. 1 according to an embodiment of the disclosure. The conductive resonator 102 may comprise, for example but without limitation, the ring conductive resonator 108, the spoked conductive resonator 110, the slot resonator 210 between the ring conductive resonator 108 and the spoked conductive resonator 110, and the like.

The ring conductive resonator 108 may comprise a ring resonator width T4 and a ring resonator inner diameter R2. The slot resonator 210 may comprise a slot resonator width T5. The spoked conductive resonator 110 may comprise an inner linked ring 204 comprising an inner linked ring width T1 and a spoked resonator inner diameter R1, an outer linked ring 206 comprising an outer linked ring width T3, a slot radiator 208 comprising a slot radiator width T2 and one or more spoke 202 coupling the inner linked ring 204 and the outer linked ring 206.

In the embodiment shown in FIG. 2, the spoked resonator inner diameter R1 is about 17 mils, the ring resonator inner diameter R2 is about 40 mils, the inner linked ring width T1 is about 5 mils, the slot radiator width T2 is about 4 mils, the outer linked ring width T3 is about 6 mils, the ring resonator width T4 is about 10 mils, and the slot resonator width T5 is about 8 mils. Other dimensions can also be used for R1, R2, T1, T2, T3, T4, and T5 to provide suitable operation of the conductive resonator 102.

The slot resonator 210, the ring conductive resonator 108, and the spoked conductive resonator 110 may comprise a tunable structure operable to tune a frequency of the slot resonator 210. R1, R2, T1, T2, T3, T4, and T5 may be chosen to suitably tune the slot resonator 210.

As mentioned above, the conductive resonator 102 may comprise a set of linked rings such as the spoked conductive resonator 110 comprising the inner linked ring 204 and the outer linked ring 206 creating a tuning structure for the slot radiator 208 between the inner linked ring 204 and the outer linked ring 206. R1, R2, T1, T2, T3, T4, and T5 may be chosen to suitably tune the slot radiator 208.

The conductive resonator 102 may comprise any material suitable for operation of the conductive resonator 102 such as, for example but without limitation, copper, polysilicon, silicon, aluminum, silver, gold, steel, meta-materials, and the like.

Figure 3:
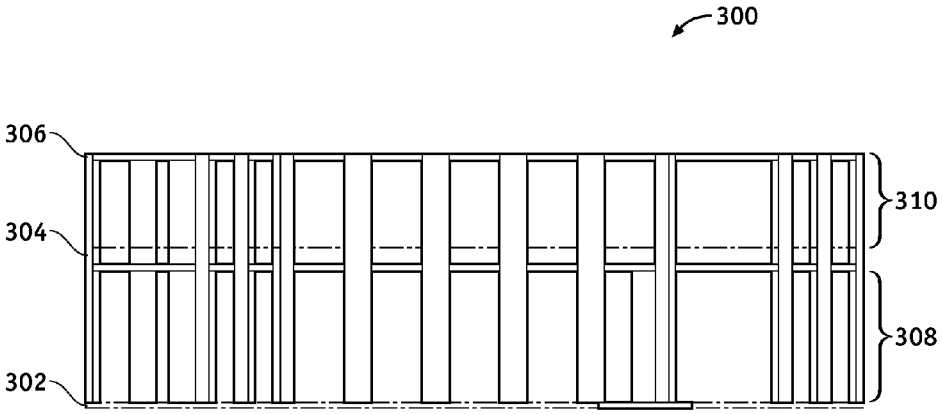
FIG. 3 is an illustration of an exemplary side view of a faraday cage of an antenna structure according to an embodiment of the disclosure.

FIG. 3 is an illustration of an exemplary side view of a faraday cage 300 (structure 300) of the antenna structure 100 according to an embodiment of the disclosure. The structure 300 may comprise an electromagnetically-shielding ground plane 302 (120 in FIG. 1), the middle layer 304 (e.g., first conductive strip 122 in FIG. 1), and a top layer 306 (e.g., second conductive strip 124 in FIG. 1). The structure 300 may be made of, for example but without limitation, a circuit board material such as a low loss material, low dielectric constant material, Rogers RT/Duroid™ 5880 boards, and the like. However the structure 300 is adaptive to any low-loss dielectric constant material. The structure 300 may comprise multiple tuned elements and multi-layered circuit boards, such as but without limitation, the conductive resonator 102 on the top layer 306, the feed lines 104 is electromagnetically coupled to the conductive resonator 102 in the middle layer 304, and the electromagnetically-shielding ground plane 302 on a lowest layer.

At least one bonding layer may be used between each of the layers such as at least one first dielectric layer 308 between the electromagnetically-shielding ground plane 302 and the middle layer 304, and at least one second dielectric layer 310 between the middle layer 304 and the top layer 306. A height of the at least one first dielectric layer 308 may comprise, for example but without limitation, about 30 mils to about 50 mils and the like, and a height of the at least one second dielectric layer 310 may comprise, for example but without limitation, about 20 mils to about 50 mils, and the like. Inclusion of the faraday cage 106 created by printed perimeters on material layers of circuit boards/substrates (electromagnetically-shielding ground planes), with the conductive vias 126 connecting the top layer 306, and any middle layers such as the middle layer 304, to the electromagnetically-shielding ground plan 302 minimizes a coupling from adjacent antenna elements and allow the structure 300 (array) to scan down to 60 degrees or better from boresight. The adjacent antenna elements may comprise, for example but without limitation, the conductive resonator 102, the feed lines 104, and the like.

Figure 4:
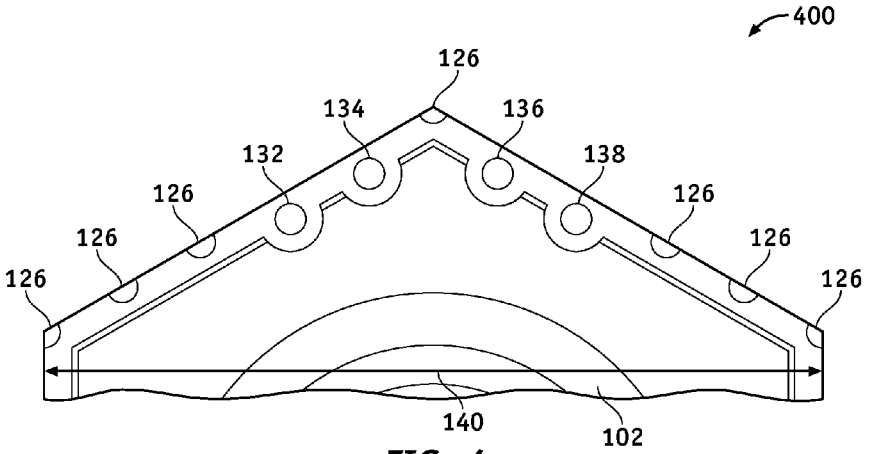
FIG. 4 is an illustration of an exemplary expanded partial top view of a faraday cage according to an embodiment of the disclosure.

FIG. 4 is an illustration of an exemplary expanded partial top view (structure 400) of the faraday cage 106 according to an embodiment of the disclosure showing the conductive vias 126, and the offset vias 132-138. The structure 400 may comprise, for example but without limitation, a linked inner ring set such as the conductive resonator 102 comprising a ring conductive resonator such as the ring conductive resonator 108, a spoked structure such as the spoked conductive resonator 110 (FIGS. 1-2), and the like.

Parameters of the structure 400 may comprise, for example but without limitation, a diameter 140 (also in FIG. 1), board thickness and choice of circuit board materials, width, length, and placement of the feed lines 104 (FIG. 1), location of the conductive vias 126 providing source energy to the structure 100, location of offset vias such as the offset vias 132-138 minimizing interaction of the feed lines 104 with the faraday cage 106, size and construction of the structure 400 printed on the circuit boards, number of layers used, number and size of the conductive vias 126 and the offset vias 132-138 used to form the structure 100/400, and the like. The diameter 140 may comprise, for example but without limitation, about 3.7 mm, and the like.

FIG. 5 is an illustration of an exemplary phased array antenna 500 (structure 500) according to an embodiment of the disclosure. The structure 500 comprises a plurality of the antenna structure 100 (FIG. 1) configured as a phased array. A significant design feature according to embodiments of the disclosure is use of the structure 500 formed by the unit cell 502 comprising the antenna structure 100. Each unit cell 502 comprising the antenna structure 100 in the structure 500 may share elements of the faraday cage 106 such as the first conductive strip 122, the second conductive strip 124, and the electromagnetically-shielding ground plane 120 with another (e.g., adjacent/neighboring) antenna structure 100. In this manner, the structure 500 comprises the lattice 506 comprising the antenna structure 100 and the faraday cage 106 thereof.

An outer boundary (comprising the faraday cage 106) of the unit cell 502 may be, for example but without limitation, outline printed on two layers of a circuit board and conductive vias 126 extending from the top layer 306 (FIG. 3), to a lowest layer at the electromagnetically-shielding ground plane 302 (FIG. 3) of the structure 100. These conductive vias 126 are spaced along the first conductive strip 122 and the second conductive strip 124 and in vertices 504 (142 in FIG. 1) of the unit cell 502.

A shape of the outer boundary (comprising the faraday cage 106) of the unit cell 502 is not limited to a hexagon as shown in FIG. 5. The unit cell 502 may comprise any appropriate shape, such as but without limitation, a triangle, a square, a hexagon, a polygon, an ellipsoid, and the like, suitable for operation of the structure 500. Also, the unit cell 502 may comprise any appropriate lattice spacing suitable for operation of the structure 500, such as but without limitation, a lattice spacing comprising the diameter 140 in FIG. 1. In this manner, the structure 500 forms the phased array antenna comprising the antenna structure 100 as an element of the lattice 506/602 (FIGS. 5-6).

As mentioned above, another significant design feature is use of the conductive resonator 102 (FIGS. 1-2) that comprises a set of linked rings such as the spoked conductive resonator 110 comprising the inner linked ring 204 and the outer linked ring 206, and operable to create a tuning structure for the slot radiator 208 between the inner linked ring 204 and the outer linked ring 206.

A combination of design features mentioned above and the faraday cage 106 (FIG. 1) minimize a substrate/ground plane guided wave propagation (e.g., through shielding of the electromagnetically-shielding ground plane 120). The combination of design features mentioned above and the faraday cage 106 also minimize a mutual coupling between neighboring adjacent antenna elements such as adjacent antenna elements of the structure 100 of the unit cell 502 adjacent to each other as shown in FIG. 5. As mentioned above, the adjacent antenna elements may comprise, for example but without limitation, the conductive resonator 102, the feed lines 104, and the like.

Antennas using slot rings and microstrip antennas may suffer from mutual coupling that limit their scan volume and bandwidth. In contrast, according to embodiments of the disclosure, a combination of the design features mentioned above and the faraday cage 106 minimizing the substrate/ground plane guided wave propagation and the mutual coupling between neighboring conductive resonators (e.g., the conductive resonator 102) of adjacent antenna elements allows the structure 500 to scan down near the horizon. Scanning down near the horizon can provide functionality suitable for a phased array for SATCOM. Further, the use of a single dual-band or multi-band aperture minimizes vehicle integration cost and size, weight, and power needs compared to single band solutions and/or dish antennas.

FIG. 6 is an illustration of an exemplary fabricated phased array antenna 600 (structure 600) according to an embodiment of the disclosure. The structure 600 has functions, material, and structures that are similar to the structure 100. Therefore, common features, functions, and elements may not be redundantly described here.

The structure 600 comprises multiple tuned elements, multi-layered circuit boards and relevant design features as explained above in the context of discussion of FIGS. 1-5. The structure 600 comprises a plurality of antenna structures 604 (structure 100 in FIGS. 1 and 5) as an element of the lattice 602 forming the fabricated phased array antenna 600. As mentioned above, the antenna structures 604 provide an antenna array that allows for single conformal aperture providing dual-band transmit and/or receive SATCOM aperture covering, for example but without limitation, both military bands of 30-31 GHz, and 43.5-45.5 GHz with the ability to extend frequency coverage down to include adjacent commercial SATCOM Ka-bands at 27.5-30 GHz, and the like.

In other embodiments, the antenna structures 604 provide an antenna array that allows for a single conformal aperture providing multi-band transmit and/or receive SATCOM aperture covering more than two frequency bands. In further embodiments, the antenna structures 604 provide an antenna array that allows for a single conformal aperture providing single-band transmit and/or receive SATCOM aperture covering a single frequency band.

In this manner, the structure 600 provides a wide scan volume, for example but without limitation, better than 60 degrees of conical scan volume from boresight, and the like, and maintains substantially good circular polarization axial ratio over specified frequency bands.

Figure 7:
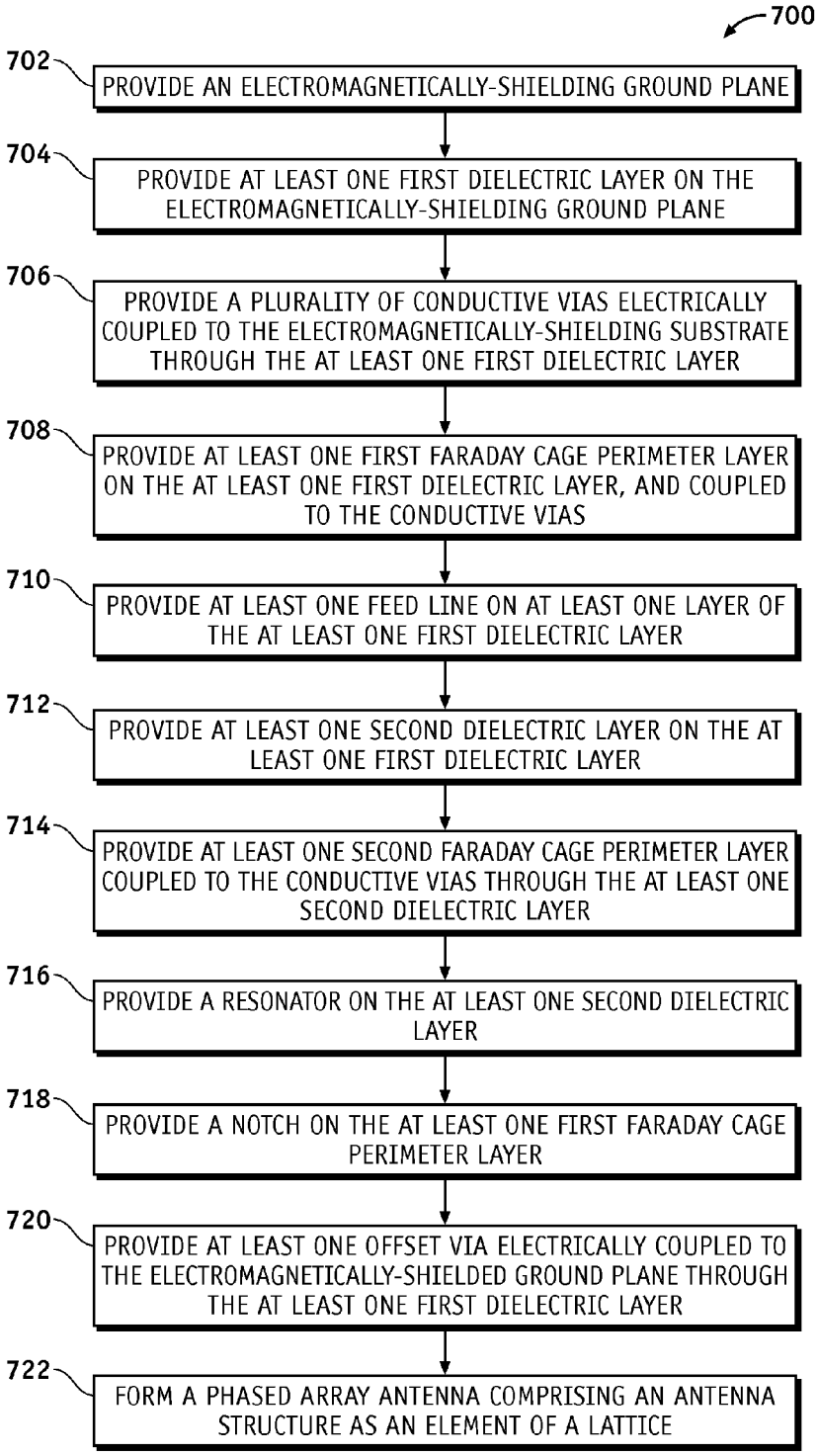
FIG. 7 is an illustration of an exemplary flowchart showing a manufacturing process for forming an antenna structure according to an embodiment of the disclosure.

FIG. 7 is an illustration of an exemplary flowchart showing an antenna structure manufacturing process 700 according to an embodiment of the disclosure. The various tasks performed in connection with process 700 may be performed mechanically, by software, hardware, firmware, or any combination thereof. It should be appreciated that process 700 may include any number of additional or alternative tasks, the tasks shown in FIG. 7 need not be performed in the illustrated order, and the process 700 may be incorporated into a more comprehensive procedure or process having additional functionality not described in detail herein.

For illustrative purposes, the following description of process 700 may refer to elements mentioned above in connection with FIGS. 1-6. In practical embodiments, portions of the process 700 may be performed by different elements of the structures 100-600 such as: the conductive resonator 102, the feed lines 104, and the faraday cage 106, etc. The process 700 may have functions, material, and structures that are similar to the embodiments shown in FIGS. 1-6. Therefore common features, functions, and elements may not be redundantly described here.

Process 700 may begin by providing an electromagnetically-shielding ground plane such as the electromagnetically-shielding ground plane 120 (task 702).

Process 700 may continue by providing at least one first dielectric layer such as the at least one first dielectric layer 308 on the electromagnetically-shielding ground plane 120/302 (task 704).

Process 700 may continue by providing a plurality of conductive vias such as the conductive vias 126 electrically coupled to the electromagnetically-shielding ground plane 120/302 through the at least one first dielectric layer 308 (task 706).

Process 700 may continue by providing at least one first faraday cage perimeter layer such as the first conductive strip 122 on the at least one first dielectric layer 308, and coupled to the conductive vias 126 (task 708).

Process 700 may continue by providing at least one feed line 104 on at least one layer of the at least one first dielectric layer 308 (task 710).

Process 700 may continue by providing at least one second dielectric layer such as the at least one second dielectric layer 310 on the at least one first dielectric layer 308 (task 712).

Process 700 may continue by providing at least one second faraday cage perimeter layer such as the second conductive strip 124 coupled to the conductive vias 126 through the at least one second dielectric layer 310 (task 714).

Process 700 may continue by providing a resonator such as the conductive resonator 102 on the at least one second dielectric layer 310 (task 716).

Process 700 may continue by providing a notch such as the first notch 128 or the second notch 130 on the at least one first faraday cage perimeter layer such as the first conductive strip 122 (task 718).

Process 700 may continue by providing at least one offset via such as one of the offset vias 132-138 electrically coupled to the electromagnetically-shielding ground plane 120 through the at least one first dielectric layer such as the first conductive strip 122 (task 720).

Process 700 may continue by forming a phased array antenna such as the phase array antenna 500-600 comprising an antenna structure such as antenna structure 100/604 formed by at least one of the tasks 702-722 of the process 700 as an element of the lattice 506/602 (task 722).

Figure 8:
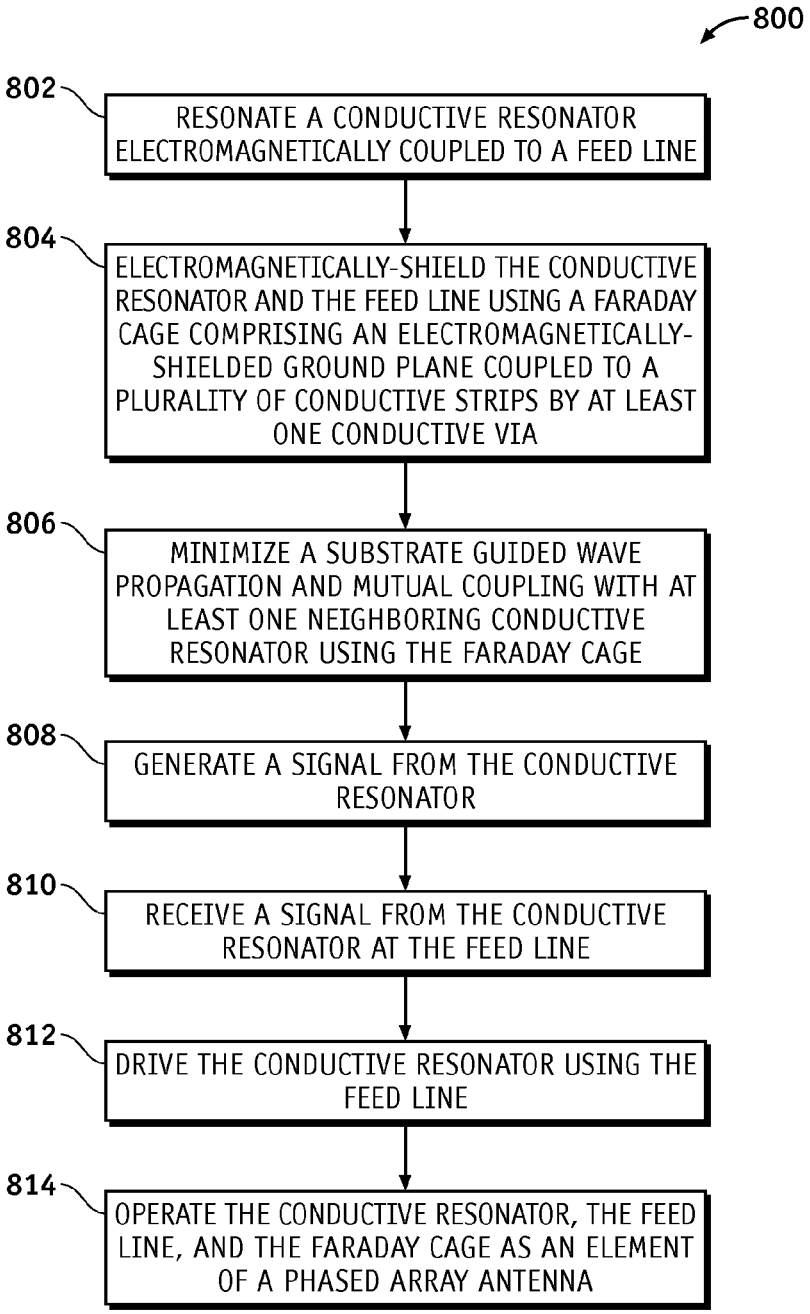
FIG. 8 is an illustration of an exemplary flowchart showing a process for communication using an antenna structure according to an embodiment of the disclosure.

FIG. 8 is an illustration of an exemplary flowchart showing a process 800 for communication using the phase array antenna 500-600 comprising the antenna structure 100/604 according to an embodiment of the disclosure. The various tasks performed in connection with process 800 may be performed mechanically, by software, hardware, firmware, or any combination thereof. It should be appreciated that process 800 may include any number of additional or alternative tasks, the tasks shown in FIG. 8 need not be performed in the illustrated order, and the process 800 may be incorporated into a more comprehensive procedure or process having additional functionality not described in detail herein.

For illustrative purposes, the following description of process 800 may refer to elements mentioned above in connection with FIGS. 1-6. In practical embodiments, portions of the process 800 may be performed by different elements of the structures 100-600 such as: the conductive resonator 102, the feed lines 104, the faraday cage 106, etc. The process 800 may have functions, material, and structures that are similar to the embodiments shown in FIGS. 1-6. Therefore common features, functions, and elements may not be redundantly described here.

Process 800 may begin by resonating a conductive resonator such as the conductive resonator 102 that is electromagnetically coupled to a feed line such as the feed line 104 (task 802).

Process 800 may continue by electromagnetically-shielding the conductive resonator 102 and the feed line 104 using a faraday cage such as the faraday cage 106 comprising an electromagnetically-shielding ground plane such as the electromagnetically-shielding ground plane 120 coupled to a plurality of conductive strips such as the conductive strips 122 and 124 by at least one conductive via such as at least one of the conductive vias 126 (task 804).

Process 800 may continue by minimizing a substrate guided wave propagation and mutual coupling with at least one neighboring conductive resonator using the faraday cage 106 (task 806). The combination of design features mentioned above and the faraday cage 106 (FIG. 1) minimize a substrate/ground plane guided wave propagation (e.g., through shielding of the electromagnetically-shielding ground plane 120). The combination of design features mentioned above and the faraday cage 106 also minimize a mutual coupling between neighboring conductive resonators (e.g., conductive resonator 102) of adjacent antenna elements such as adjacent antenna structures 100/604.

Minimizing the substrate/ground plane guided wave propagation and the mutual coupling between neighboring conductive resonators (e.g., conductive resonator 102) of adjacent antenna elements allows the structures 500/600 to scan down near the horizon. Scanning down near the horizon can provide functionality suitable for a phased array for SATCOM. The neighboring conductive resonator may comprise the conductive resonator 102 of the adjacent antenna structures 100/604 of the phase array antenna 500/600.

Process 800 may continue by generating a signal from the conductive resonator 102 (task 808).

Process 800 may continue by receiving a signal from the conductive resonator 102 at the feed line 104 (task 810).

Process 800 may continue by driving conductive resonator 102 using the feed line 104 (task 812).

Process 800 may continue by operating the conductive resonator 102, the feed line 104, and the faraday cage 106 as an element of the phased array antenna 600 (task 814).

In this way, embodiments of the disclosure provide antenna systems and methods that minimize size, weight, and power (SWAP), as well as minimizing integration cost. As mentioned above, the SWAP is greatly reduced by elimination of "stovepiped" SATCOM banded systems and associated separate antenna installations. Embodiments provide a phased array antenna that can cover at least one SATCOM transmit and/or receive military EHF band, while being thin and lightweight. Embodiments can be scaled to other frequency bands and phased array antenna applications such as, for example but without limitation, Line-of-Sight communication links, SIGINT arrays, radars, sensor arrays, and the like. Embodiments of the disclosure provide a conformal antenna operable to greatly reduce aerodynamic drag and integration/maintenance cost.

The above description refers to elements or nodes or features being "connected" or "coupled" together. As used herein, unless expressly stated otherwise, "connected" means that one element/node/feature is directly joined to (or directly communicates with) another element/node/feature, and not necessarily mechanically. Likewise, unless expressly stated otherwise, "coupled" means that one element/node/feature is directly or indirectly joined to (or directly or indirectly communicates with) another element/node/feature, and not necessarily mechanically. Thus, although FIGS. 1-2 depict example arrangements of elements, additional intervening elements, devices, features, or components may be present in an embodiment of the disclosure.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future.

Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The term "about" when referring to a numerical value or range is intended to encompass values resulting from experimental error that can occur when taking measurements.

The invention claimed is:

1. An antenna structure comprising:

a conductive resonator configured on one layer and comprising a ring resonator, a spoked resonator comprising linked rings configured within the ring resonator, an outer slot resonator between the ring resonator and the spoked resonator, and an inner slot resonator between the linked rings;

a feed line electromagnetically coupled to the conductive resonator and configured to operate the conductive resonator in at least two frequency bands; and a faraday cage operable to shield the conductive resonator and the feed line, the faraday cage comprising an electromagnetically-shielding ground plane coupled to a plurality of conductive strips by at least one conductive via.

2. The antenna structure according to claim 1, wherein the feed line is electromagnetically coupled to the conductive resonator via an electromagnetic coupling comprising at least one member selected from the group consisting of: capacitive coupling, and inductive coupling.

3. The antenna structure according to claim 1, wherein the feed line is operable to drive the conductive resonator.

4. The antenna structure according to claim 1, wherein the feed line is operable to receive a signal from the conductive resonator.

5. The antenna structure according to claim 1, wherein the conductive resonator comprises a set of linked rings comprising an inner linked ring and an outer linked ring configured on the one layer, and a slot radiator configured on the one layer between the inner linked ring and the outer linked ring, wherein the set of linked rings is operable to create a tuning structure for the slot radiator.

6. The antenna structure according to claim 1, wherein the conductive resonator comprises at least one member selected from the group consisting of: at least one spoke structure, at least one ring structure, and a plurality of resonators configured on the one layer.

7. The antenna structure according to claim 1, wherein the faraday cage further comprises at least one member selected from the group consisting of: at least one offset via, and a notch offset from the feed line.

8. The antenna structure according to claim 1, wherein the antenna structure forms a phased array antenna wherein the conductive strips form a lattice.

9. A method for forming an antenna structure, the method comprising:

providing an electromagnetically-shielding ground plane;

providing at least one first dielectric layer on the electromagnetically-shielding ground plane;

providing a plurality of conductive vias electrically coupled to the electromagnetically-shielding ground plane through the at least one first dielectric layer;

providing at least one first faraday cage perimeter layer on the at least one first dielectric layer, and coupled to the conductive vias;

providing at least one feed line on at least one layer of the at least one first dielectric layer, the at least one feed line configured to operate a resonator in at least two frequency bands;

providing at least one second dielectric layer on the at least one first dielectric layer;

providing at least one second faraday cage perimeter layer coupled to the conductive vias through the at least one second dielectric layer; and providing the resonator configured on one layer of the at least one second dielectric layer and comprising a ring resonator, a spoked resonator comprising linked rings configured within the ring resonator, an outer slot resonator between the ring resonator and the spoked resonator, and an inner slot resonator between the linked rings.

10. The method according to claim 9, wherein the resonator comprises at least one member selected from the group consisting of: at least one spoke structure, at least one ring structure, and a plurality of resonators configured on the one layer.

11. The method according to claim 9, further comprising providing a notch on the at least one first faraday cage perimeter layer.

12. The method according to claim 9, further comprising providing at least one offset via electrically coupled to the electromagnetically-shielding ground plane through the at least one first dielectric layer.

13. The method according to claim 9, further comprising forming a phased array antenna comprising the antenna structure as an element of a lattice.

14. A method for communication using an antenna structure, the method comprising:

resonating a conductive resonator electromagnetically coupled to a feed line, the conductive resonator configured on one layer, and comprising a ring resonator, a spoked resonator comprising linked rings configured within the ring resonator, an outer slot resonator between the ring resonator and the spoked resonator, and an inner slot resonator between the linked rings, and the feed line configured to operate the conductive resonator in at least two frequency bands; and electromagnetically-shielding the conductive resonator and the feed line using a faraday cage comprising an electromagnetically-shielding ground plane coupled to a plurality of conductive strips by at least one conductive via.

15. The method according to claim 14, further comprising minimizing a substrate guided wave propagation and mutual coupling with at least one neighboring conductive resonator using the faraday cage.

16. The method according to claim 14, further comprising generating a signal from the conductive resonator.

17. The method according to claim 14, further comprising receiving a signal from the conductive resonator at the feed line.

18. The method according to claim 14, further comprising driving the conductive resonator using the feed line.

19. The method according to claim 14, further comprising operating the conductive resonator, the feed line, and the faraday cage as an element of a phased array antenna.

20. The method according to claim 14, wherein the conductive resonator comprises at least one member selected from the group consisting of: at least one spoke structure, at least one ring structure, and a plurality of resonators configured on the one layer.

* * * * *